United States Patent [19]

Sunaga et al.

[11] Patent Number: 4,488,802

[45] Date of Patent: Dec. 18, 1984

[54] ELECTROPHOTOGRAPHIC DEVICE WITH SINGLE STATIONS SERVING MULTIPLE FUNCTIONS

[75] Inventors: Ryuzo Sunaga; Seiji Joh, both of Kanagawa, Japan

[73] Assignee: Fuji Xerox Co., Ltd., Tokyo, Japan

[21] Appl. No.: 458,078

[22] Filed: Jan. 14, 1983

[30] Foreign Application Priority Data

Jan. 14, 1982 [JP] Japan ..... 57-3292

[51] Int. Cl.[3] ..... G03G 15/08

[52] U.S. Cl. ..... 355/3 CH; 355/3 DD; 355/14 D; 355/14 CH; 355/15; 118/621; 430/125; 430/126

[58] Field of Search ..... 355/3 DD, 14 D, 3 CH, 355/14 CH, 15, 3 R, 14 TR, 3 TR; 430/110, 120, 121, 122, 130, 48, 125, 126; 118/620, 621, 623

[56] References Cited

U.S. PATENT DOCUMENTS

| | | | |
|---|---|---|---|
| 3,637,306 | 1/1972 | Cooper | 355/15 |
| 3,640,707 | 2/1972 | Caldwell | 430/121 |
| 3,647,293 | 3/1972 | Queener | 355/15 |
| 3,655,374 | 4/1972 | Palermiti et al. | 430/121 |
| 3,660,863 | 5/1972 | Gerbasi et al. | 355/15 |
| 3,898,171 | 8/1975 | Westdale | 430/110 |
| 3,961,953 | 6/1976 | Millonzi et al. | 430/130 X |

*Primary Examiner*—A. C. Prescott

*Attorney, Agent, or Firm*—Sughrue, Mion, Zinn, Macpeak and Seas

[57] ABSTRACT

An electrophotographing device for copying is small and inexpensive to manufacture due to the placement of multiple functions at single operating stations. A copying operation is carried out during two revolutions of a photo-sensitive member rather than one revolution as in the conventional copying operation.

7 Claims, 1 Drawing Figure

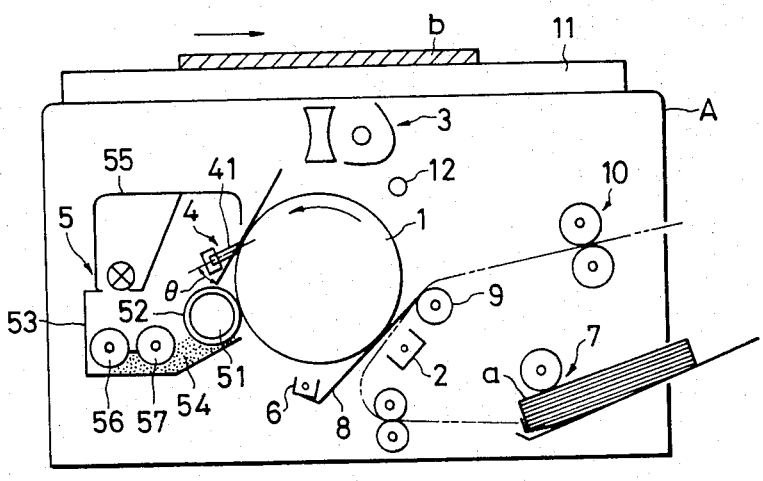
b
11
A
3
12
10
55
41
5
4
1
θ
52
9
53
7
51
2
a
56
57
54
6
8

ELECTROPHOTOGRAPHIC DEVICE WITH SINGLE STATIONS SERVING MULTIPLE FUNCTIONS

BACKGROUND OF THE INVENTION

This invention relates to an electrophotographing device in which one copying operation is carried out by allowing a photo-sensitive member to make two revolutions.

In a conventional electrophotographing device having a drum-shaped or belt-shaped photo-sensitive member, a charging unit, an exposing unit, a developing unit, a transferring unit, a discharging unit, a cleaning unit and a fatigue recovering unit are arranged around the photo-sensitive member in the stated order. While the photo-sensitive member makes one revolution, these units carry out charging, exposing, developing, transferring, discharging, cleaning and fatigue-recovering, to achieve one copying operation.

However, the conventional electrophotographing device is typically large and expensive to manufacture because it requires a plurality of charging units for charging, transferring, auxiliary-cleaning and sheet-peeling.

SUMMARY OF THE INVENTION

In view of the foregoing, an object of this invention is to provide an electrophotographing device which is small and relatively inexpensive to manufacture.

BRIEF DESCRIPTION OF THE DRAWINGS

One embodiment of this invention will be described with reference to the accompanying drawing which is an explanatory diagram showing the entire arrangement of one embodiment of the invention. The object is accomplished by providing multiple functions at an operating station adjacent the photo-sensitive member and actuating the separate functions during separate revolutions of the photo-sensitive member.

DETAILED DESCRIPTION OF THE INVENTION

A copying machine body A has a rotatable drum-shaped photo-sensitive member 1. A charging and transferring unit (or a charging unit) 2, an exposing unit 3, a cleaning unit 4, a developing unit 5 and a fatigue recovering unit 6 are disposed around the photo-sensitive member 1 in the stated order in the direction of rotation. The photo-sensitive member 1 may be belt-shaped.

Further in the single FIGURE, reference numeral 7 designates a sheet feeding device; 8, a separating belt for peeling off a transferring sheet a from the photo-sensitive drum; 9, a conveying unit; 10, a fixing unit; 11, a platen which is provided on the copying machine body A in such a manner as to reciprocate; and 12, a lamp.

The details and operations of these components will be described.

An original b is set on the platen 11, and is moved in the direction of the arrow in response to a copying starting signal.

The photo-sensitive member 1 is turned at a predetermined speed in the direction of the arrow. Therefore, first, the photo-sensitive member is charged in its entirety by the charging and transferring unit 2 in the charging process. Then, an object to be copied, i.e., the image of the original b is exposed to light by the exposing unit 3, so that the electrostatic latent image thereof is formed on the photo-sensitive member 1.

The electrostatic latent image on the photo-sensitive member 1 is developed into a toner image with dry toner by the developing unit 5.

The developing unit 5 serves as a magnetic brush type developing unit. In other words, the developing agent 54 in a container 53 is supplied to the photo-sensitive member 1 by a non-magnetic sleeve 52 which incorporates a magnet 51 and is turned at a predetermined speed by a drive so that the latent image is developed into the toner image by the toner included in the developing agent 54.

By this operation, the photo-sensitive member 1 has made one revolution. In the next revolution, the toner image on the photo-sensitive member 1 reaches the charging and transferring unit 2, where the toner image is transferred onto the transferring sheet a which is delivered thereto in synchronization with the photo-sensitive member 1, when the operation of the charging and transferring unit 2 is switched over to the transferring operation.

The transferring sheet a onto which the toner image has been transferred is peeled off from the photo-sensitive member 1 by the separating belt 8, and is then conveyed to the fixing unit 10 by the conveying unit 9. In the fixing unit 10, the toner image is fixed. Thus, a copy of the original is outputted.

The electrostatic latent image is erased from the photo-sensitive member 1 by light from the lamp 12, which has accomplished the transferring operation. That is, the latent image is eliminated so that it may not be developed by the developing unit 5. A part of the developing agent supplied to the photo-sensitive member 1 by the sleeve 52 of the developing unit 5, which has remained on the photo-sensitive member 1 is scraped off by the blade 41 of the cleaning unit 4. On the other hand, toner is supplied into the container 53 by the toner supplying unit 55, and the toner in the container 53 is mixed with the carrier by the mixer 56. The mixer thus prepared is supplied onto the sleeve 52 by a paddle 57.

Thereafter, the fatigue of the photo-sensitive member 1 is recovered by the fatigue recovering unit 6. Thus, the photo-sensitive member 1 has made the second revolution.

The platen 11 is moved in a direction opposite to the direction of the arrow in synchronization with the second revolution of the photo-sensitive member 1. In this operation, the exposing unit 3 is not operated.

As is apparent from the above description, while the photo-sensitive member 1 makes one revolution, the steps of charging, exposing and developing are carried out, and in the next revolution of the member 1 the steps of sheet-feeding, transferring, cleaning and fatigue recovery are performed.

The cleaning unit 4 has a blade 41 which is positioned above sleeve 52 in a container 53 of the developing unit 5. The toner is scraped off from the photo-sensitive member 1 by the blade 41. The toner thus scraped off is moved along the blade 41 into the container 53 by its own weight and inertia, for reuse.

Since the blade 41 is in contact with the photo-sensitive member under pressure at all times, the latent image formed on the photo-sensitive member 1 may be adversely affected when the blade 41 is brought into contact with the latent image. However, in the preferred embodiment of the invention, the photo-sensitive member 1 is made of a selenium series photo-sensitive material, and a film of zinc stearate (whose thickness may be 100 Å or less) is formed on the surface of the photo-sensitive member, in order to eliminate the above-described influence on the electrostatic latent image.

The film of zinc stearate may be formed according to a method in which zinc stearate in the form of fine powder is mixed into the developing agent, and the mixture thus prepared together with the toner is supplied to the surface of the photo-sensitive member in the step of developing, or zinc stearate is supplied to the surface of the photo-sensitive member externally with a brush or a web.

In order that the electrostatic latent image is not adversely affected, the blade 41 should be made of polyurethane about 70° in hardness, 20 mm in thickness and 11 mm in free length, the blade 41 should form an angle of 20° to 25° with the tangential line of the photo-sensitive member, and the blade 41 should contact the photo-sensitive member under a pressure of 1.25 to 2.0 g/mm$^2$.

A magnetic brush cleaning unit serving as a developing unit and a cleaning unit is known in the art. However, the employment of such a cleaning unit is undesirable due to the following reasons. In order to reduce the force of adhesion of toner to the photo-sensitive member, auxiliary cleaning means is necessary, i.e., it is necessary to neutralize a photo-sensitive member surface potential with light, it is necessary to neutralize the photo-sensitive member surface potential by allowing the photo-sensitive member and the toner to undergo AC discharging, it is necessary to increase the force of repulsion of toner from the photo-sensitive member, and it is necessary to increase the force of attraction between the toner and the carrier. Furthermore, in order to utilize the electric field between the photo-sensitive member and the magnetic roll, DC discharging is required. Accordingly, in addition to the charging unit for charging and transferring, a discharging unit is required. In addition, the bias of the magnetic roll must be changed separately according to the developing operation and the cleaning operation.

Therefore, the employment of the above-described magnetic brush cleaning unit makes it impossible to miniaturize the device and to manufacture it at low cost.

In addition, a web and brush cleaning unit is also known in the art. However, in order to improve the cleaning characteristic and the maintenance, it is necessary to use an AC or DC charging unit. Thus, the employment of the web and brush cleaning unit is not suitable for miniaturizing the device and for manufacturing it at low cost.

In the invention, the cleaning unit with the blade 41 is used, but no additional charging unit is employed, in order to miniaturize the device and to manufacture it at low cost.

Hereinafter, the blade 41 which forms an angle $\theta$ smaller than 90° with the tangential line will be referred to as "a doctor-direction-arranged blade 41", when applicable, and the blade 41 which forms an angle of from 90° to 180° with the tangential line will be referred to as a "wiper-direction-arranged blade 41", when applicable. A doctor-direction-arranged blade has much better cleaning and holding capabilities than a wiper-direction-arranged blade.

In the case of a doctor-direction-arranged blade, as the frictional co-efficient between the selenium of the selenium series photo-sensitive member without zinc stearate and the polyurethane blade is 1.1 or more, a stick slip motion is caused, and it is impossible for the blade to clean adequately the selenium series photo-sensitive member. If toner is on the photo-sensitive member, the frictional co-efficient is reduced to about 0.9. However, if, in this case, the force of adhesion of the toner to the photo-sensitive member is large, then there will still be a stick slip motion. Accordingly, in the case where the doctor-direction-arranged blade is employed for a selenium series photo-sensitive member, not having a zinc stearate coating, in order to reduce the force of adhesion a cleaning AC or DC charging unit might be employed as an auxiliary means.

However, in the preferred embodiment of the present invention, a film of zinc stearate is formed on the surface of the photo-sensitive member, and therefore even when the doctor-direction-arranged blade is employed, the toner can be cleaned without using an auxiliary cleaning means, such as a separate charging unit.

Accordingly, the electrophotographing device according to the invention can be reduced in dimension and manufactured at low cost.

As was described above, in the device according to the invention, charging and transferring can be carried out by the charging and transferring unit 2, i.e., one charging unit, which contributes to a reduction of the number of charging units employed. Furthermore, the blade 41 of the cleaning unit 4 is incorporated in the developing unit 5. Accordingly, it is unnecessary to externally provide a space for the blade 41, and the toner recovered by cleaning drops directly into the developing unit 5, which makes it unnecessary to provide a particular recovered-toner conveying mechanism.

Thus, the electrophotographing device according to the invention is small, has a low weight, is inexpensive to manufacture and simple to construct.

As the number of charging units is reduced, the cost for the charging units decreases, and the capacity of the high voltage source for the charging units and the number of outputs therefrom can be decreased.

We claim:

1. An electrophotographing device for copying from an original onto a transfer sheet by charging, exposing, developing, transferring and cleaning, said device comprising:

a photo-sensitive member arranged to revolve past operating stations during a copying operation, a developing and cleaning unit means located at one operating station for applying toner to said photo-sensitive member and for cleaning said photo-sensitive member during alternate revolutions of said photo-sensitive member, respectively, said developing and cleaning unit means having a wiper blade positioned therein to provide the cleaning operation of said copying operation, and a charging and transferring unit means located at another operating station for alternately carrying out the charging and transferring operations of said copying operation during alternate revolutions of said photo-sensitive member past said charging and transferring unit means, whereby said copying operation requires two revolutions of said photo-sensitive member.

2. An electrophotographing device as claimed in claim 1 wherein said wiper blade is arranged as a doctor blade with one end pressing against said photo-sensitive member.

3. An electrophotographing device as claimed in claim 1 wherein said photo-sensitive member is made of selenium and has a coating of zinc stearate thereon.

4. An electrophotographing device as claimed in claim 2 wherein said photo-sensitive member is made of selenium and has a coating of zinc stearate thereon.

5. An electrophotographing device as claimed in claim 2 wherein said developing and cleaning unit comprises a holding means for receiving and holding toner for application to said photo-sensitive member, and an application means for applying toner from said holding means to said photo-sensitive member, said wiper blade being positioned so that toner removed thereby from said photo-sensitive member falls along said wiper blade into said holding means.

6. An electrophotographing device as claimed in claim 5 wherein said photo-sensitive member is made of selenium and has a coating of zinc stearate thereon.

7. A method of electrophotographing an original comprising the steps of:

(a) revolving a photo-sensitive member for two revolutions;

(b) charging said photo-sensitive member during said first revolution;

(c) exposing said charged photo-sensitive member to an image of said original during the first revolution to form a latent image;

(d) developing said latent image during said first revolution by applying toner to said photo-sensitive member;

(e) transferring said developed image to transfer paper during the second revolution;

(f) removing said latent image during said second revolution by exposing said photo-sensitive member to light; and (g) cleaning the toner from said photo-sensitive member during said second revolution.

* * * * *